US011844156B1

(12) United States Patent
Chung et al.

(10) Patent No.: US 11,844,156 B1
(45) Date of Patent: Dec. 12, 2023

(54) LED ILLUMINATION DEVICE AND COLOR TEMPERATURE SWITCHING METHOD THEREOF

(71) Applicant: PARAGON SEMICONDUCTOR LIGHTING TECHNOLOGY CO., LTD., New Taipei (TW)

(72) Inventors: Chia-Tin Chung, Miaoli County (TW); Pei-Chun Liu, New Taipei (TW); Yi-Chun Liu, New Taipei (TW)

(73) Assignee: PARAGON SEMICONDUCTOR LIGHTING TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 18/145,826

(22) Filed: Dec. 22, 2022

(30) Foreign Application Priority Data

Nov. 15, 2022 (TW) ..... 111143513

(51) Int. Cl.
*H05B 45/20* (2020.01)
*H05B 45/54* (2020.01)
*H05B 45/325* (2020.01)
*H05B 45/37* (2020.01)

(52) U.S. Cl.
CPC ..... *H05B 45/20* (2020.01); *H05B 45/325* (2020.01); *H05B 45/37* (2020.01); *H05B 45/54* (2020.01)

(58) Field of Classification Search
CPC ..... H05B 45/20; H05B 45/325; H05B 45/37; H05B 45/54
See application file for complete search history.

(56) References Cited

U.S. PATENT DOCUMENTS

2021/0298150 A1* 9/2021 Chung ..... H05B 45/39
2022/0262322 A1* 8/2022 Pang ..... H05B 45/34

* cited by examiner

*Primary Examiner* — Minh D A
(74) *Attorney, Agent, or Firm* — Li & Cai Intellectual Property Office

(57) ABSTRACT

An LED illumination device and a color temperature switching method thereof are provided. The LED illumination device includes a bridge rectifier chip, a microcontroller module, a first semiconductor switch module, a second semiconductor switch module, a first current limiting module, a second current limiting module, and a first light-emitting module and a second light-emitting module. The microcontroller module includes a microcontroller chip. The first semiconductor switch module includes a first semiconductor switch chip for receiving a first pulse width modulation signal output from the microcontroller chip. The second semiconductor switch module includes a second semiconductor switch chip for receiving a second pulse width modulation signal output from the microcontroller chip. When the AC power is supplied to the LED illumination device, the first and the second semiconductor switch modules are turned on and maintained within a predetermined turn-on percentage range without being completely turned off.

10 Claims, 10 Drawing Sheets

LED ILLUMINATION DEVICE AND COLOR TEMPERATURE SWITCHING METHOD THEREOF

CROSS-REFERENCE TO RELATED PATENT APPLICATION

This application claims the benefit of priority to Taiwan Patent Application No. 111143513, filed on Nov. 15, 2022. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an LED illumination device and a color temperature switching method thereof, and more particularly to an LED illumination device for avoiding the situation of no luminous flux and a color temperature switching method thereof.

BACKGROUND OF THE DISCLOSURE

In the related art, when the lighting device switches the color temperature, there will be a short-term no luminous flux (i.e., the brightness percentage drops to 0%), so that it is very inconvenient for users who need to perform precise operations or for instruments that need to quickly capture images.

SUMMARY OF THE DISCLOSURE

In response to the above-referenced technical inadequacy, the present disclosure provides an LED illumination device and a color temperature switching method thereof.

In order to solve the above-mentioned problems, one of the technical aspects adopted by the present disclosure is to provide an LED illumination device, which includes a circuit substrate, a bridge rectifier chip, a microcontroller module, a first semiconductor switch module, a second semiconductor switch module, a first current-limiting module, a second current-limiting module, a first light-emitting module and a second light-emitting module. The circuit substrate includes a first AC (alternating current) power input terminal and a second AC power input terminal, and both the first AC power input terminal and the second AC power input terminal are configured for receiving an AC power. The bridge rectifier chip is disposed on the circuit substrate and electrically connected to the circuit substrate, and the bridge rectifier chip is electrically connected between the first AC power input terminal and the second AC power input terminal for converting the AC power into a DC (direct current) power. The microcontroller module is disposed on the circuit substrate and electrically connected to the circuit substrate, in which the microcontroller module includes a microcontroller chip and a power supply circuit electrically connected to the microcontroller chip, the microcontroller module is electrically connected to the bridge rectifier chip through the power supply circuit, and the power supply circuit includes a plurality of resistor chips, a plurality of capacitor chips and a plurality of voltage stabilizing diode chips. The first semiconductor switch module is disposed on the circuit substrate and electrically connected to the circuit substrate, and the first semiconductor switch module includes a first semiconductor switch chip for receiving a first pulse width modulation signal output by the microcontroller chip. The second semiconductor switch module is disposed on the circuit substrate and electrically connected to the circuit substrate, and the second semiconductor switch module includes a second semiconductor switch chip for receiving a second pulse width modulation signal output by the microcontroller chip. The first current-limiting module is disposed on the circuit substrate and electrically connected to the circuit substrate, and the first current-limiting module includes a first current-limiting chip electrically connected to the first semiconductor switch module. The second current-limiting module is disposed on the circuit substrate and electrically connected to the circuit substrate, and the second current-limiting module includes a second current-limiting chip electrically connected to the second semiconductor switch module. The first light-emitting module is disposed on the circuit substrate and electrically connected to the circuit substrate, and the first light-emitting module includes a plurality of first LED chips electrically connected between the bridge rectifier chip and the first current-limiting chip. The second light-emitting module is disposed on the circuit substrate and electrically connected to the circuit substrate, and the second light-emitting module includes a plurality of second LED chips electrically connected between the bridge rectifier chip and the second current-limiting chip. When the AC power is supplied to the LED illumination device through the circuit substrate, both the first semiconductor switch module and the second semiconductor switch module are turned on and maintained within a predetermined turn-on percentage range without being completely turned off. When the first semiconductor switch module is turned on 100%, a first predetermined current is transmitted to the first light-emitting module through the first semiconductor switch module and the first current-limiting module. When the second semiconductor switch module is turned on 100%, a second predetermined current is transmitted to the second light-emitting module through the second semiconductor switch module and the second current-limiting module. When the first pulse width modulation signal is transmitted to the first semiconductor switch module at a first predetermined time point through the microcontroller chip of the microcontroller module, the first semiconductor switch module is turned on between a minimum predetermined percentage and 100%, so that the first predetermined current between a minimum predetermined percentage and 100% is correspondingly transmitted to the first light-emitting module through the first semiconductor switch module. When the second pulse width modulation signal is transmitted to the second semiconductor switch module at a second predetermined time point through the microcontroller chip of the microcontroller module, the second semiconductor switch module is turned on between a minimum predetermined percentage and 100%, so that the second predetermined current between a minimum predetermined percentage and 100% is correspondingly transmitted to the second light-emitting module through the second semiconductor switch module. When the first predetermined time point is earlier than the second predetermined time point, 100% of the first predetermined current is transmitted to the first light-emitting module through the first semiconductor switch module, and the minimum predetermined percentage of the second predetermined current is transmitted to the second light-emitting module through the second semiconductor switch module, each of the first LED chips is configured to generate a first predetermined color light source with 100% brightness, and each of the second LED chips is configured to generate a second predetermined color light source with a minimum percentage brightness. When the second predetermined time point is earlier than the first predetermined time point, the minimum predetermined percentage of the first predetermined current is transmitted to the first light-emitting module through the first semiconductor switch module, and 100% of the second predetermined current is transmitted to the second light-emitting module through the second semiconductor switch module, each of the first LED chips is configured to generate a first predetermined color light source with a minimum percentage brightness, and each of the second LED chips is configured to generate a second predetermined color light source with 100% brightness.

In order to solve the above-mentioned problems, another one of the technical aspects adopted by the present disclosure is to provide an LED illumination device, which includes a circuit substrate, a bridge rectifier chip, a microcontroller module, a first semiconductor switch module, a second semiconductor switch module, a first current-limiting module, a second current-limiting module, a first light-emitting module and a second light-emitting module. The circuit substrate includes a first AC power input terminal and a second AC power input terminal. The bridge rectifier chip is electrically connected between the first AC power input terminal and the second AC power input terminal. The microcontroller module includes a microcontroller chip and a power supply circuit electrically connected to the microcontroller chip, and the microcontroller module is electrically connected to the bridge rectifier chip through the power supply circuit. The first semiconductor switch module includes a first semiconductor switch chip for receiving a first pulse width modulation signal output by the microcontroller chip. The second semiconductor switch module includes a second semiconductor switch chip for receiving a second pulse width modulation signal output by the microcontroller chip. The first current-limiting module includes a first current-limiting chip electrically connected to the first semiconductor switch module. The second current-limiting module includes a second current-limiting chip electrically connected to the second semiconductor switch module. The first light-emitting module includes a plurality of first LED chips electrically connected between the bridge rectifier chip and the first current-limiting chip. The second light-emitting module includes a plurality of second LED chips electrically connected between the bridge rectifier chip and the second current-limiting chip. When an AC power is supplied to the LED illumination device through the circuit substrate, both the first semiconductor switch module and the second semiconductor switch module are turned on and maintained within a predetermined turn-on percentage range without being completely turned off.

In order to solve the above-mentioned problems, yet another one of the technical aspects adopted by the present disclosure is to provide a color temperature switching method of the LED illumination device. When the AC power is supplied to the LED illumination device through the circuit substrate, both the first semiconductor switch module and the second semiconductor switch module are turned on and maintained within the predetermined turn-on percentage range without being completely turned off, so that both the first capacitor chip and the second capacitor chip are maintained in a fully charged state. When the first semiconductor switch module is turned on 100%, a first predetermined current is transmitted to the first light-emitting module through the first semiconductor switch module and the first current-limiting module. When the second semiconductor switch module is turned on 100%, a second predetermined current is transmitted to the second light-emitting module through the second semiconductor switch module and the second current-limiting module. When the first pulse width modulation signal is transmitted to the first semiconductor switch module at a first predetermined time point through the microcontroller chip of the microcontroller module, the first semiconductor switch module is turned on between a minimum predetermined percentage and 100%, so that the first predetermined current between a minimum predetermined percentage and 100% is correspondingly transmitted to the first light-emitting module through the first semiconductor switch module. When the second pulse width modulation signal is transmitted to the second semiconductor switch module at a second predetermined time point through the microcontroller chip of the microcontroller module, the second semiconductor switch module is turned on between a minimum predetermined percentage and 100%, so that the second predetermined current between a minimum predetermined percentage and 100% is correspondingly transmitted to the second light-emitting module through the second semiconductor switch module. When the first predetermined time point is earlier than the second predetermined time point, 100% of the first predetermined current is transmitted to the first light-emitting module through the first semiconductor switch module, and the minimum predetermined percentage of the second predetermined current is transmitted to the second light-emitting module through the second semiconductor switch module, each of the first LED chips is configured to generate a first predetermined color light source with 100% brightness, and each of the second LED chips is configured to generate a second predetermined color light source with a minimum percentage brightness. When the second predetermined time point is earlier than the first predetermined time point, the minimum predetermined percentage of the first predetermined current is transmitted to the first light-emitting module through the first semiconductor switch module, and 100% of the second predetermined current is transmitted to the second light-emitting module through the second semiconductor switch module, each of the first LED chips is configured to generate a first predetermined color light source with a minimum percentage brightness, and each of the second LED chips is configured to generate a second predetermined color light source with 100% brightness.

Therefore, in the LED illumination device and the color temperature switching method provided by the present disclosure, by virtue of "the microcontroller module including a microcontroller chip and a power supply circuit electrically connected to the microcontroller chip," "the first semiconductor switch module including a first semiconductor switch chip for receiving a first pulse width modulation signal output by the microcontroller chip," "the second semiconductor switch module including a second semiconductor switch chip for receiving a second pulse width modulation signal output by the microcontroller chip," "the first current-limiting module including a first current-limiting chip electrically connected to the first semiconductor switch module," "the second current-limiting module including a second current-limiting chip electrically connected to the second semiconductor switch module," "the first light-emitting module including a plurality of first LED chips electrically connected between the bridge rectifier chip and the first current-limiting chip" and "the second light-emitting module including a plurality of second LED chips electrically connected between the bridge rectifier chip and the second current-limiting chip," when an AC power is supplied to the LED illumination device through the circuit substrate, both the first semiconductor switch module and the second semiconductor switch module are turned on and maintained within a predetermined turn-on percentage range without being completely turned off.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
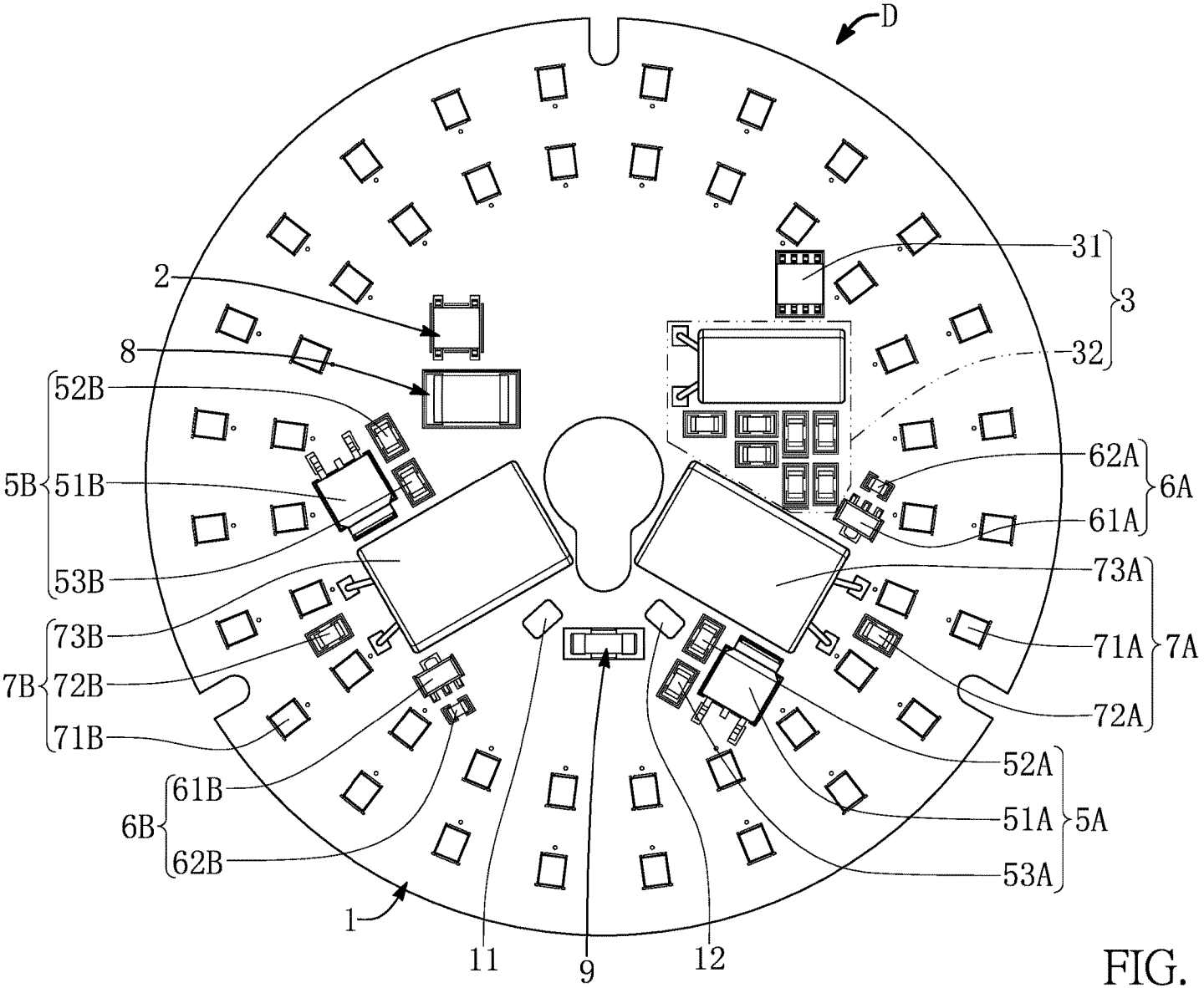
FIG. 1 is a schematic top view of an LED illumination device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an" and "the" includes plural reference, and the meaning of "in" includes "in" and "on." Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 3 and FIG. 7 to FIG. 9, a first embodiment of the present disclosure provides an LED illumination device D (or an LED lighting device) and a color temperature switching method of the LED illumination device D, and the LED illumination device D includes a circuit substrate 1, a bridge rectifier chip 2, a microcontroller module 3, a first semiconductor switch module 5A, a second semiconductor switch module 5B, a first current-limiting module 6A, a second current-limiting module 6B, a first light-emitting module 7A and a second light-emitting module 7B.

Figure 3:
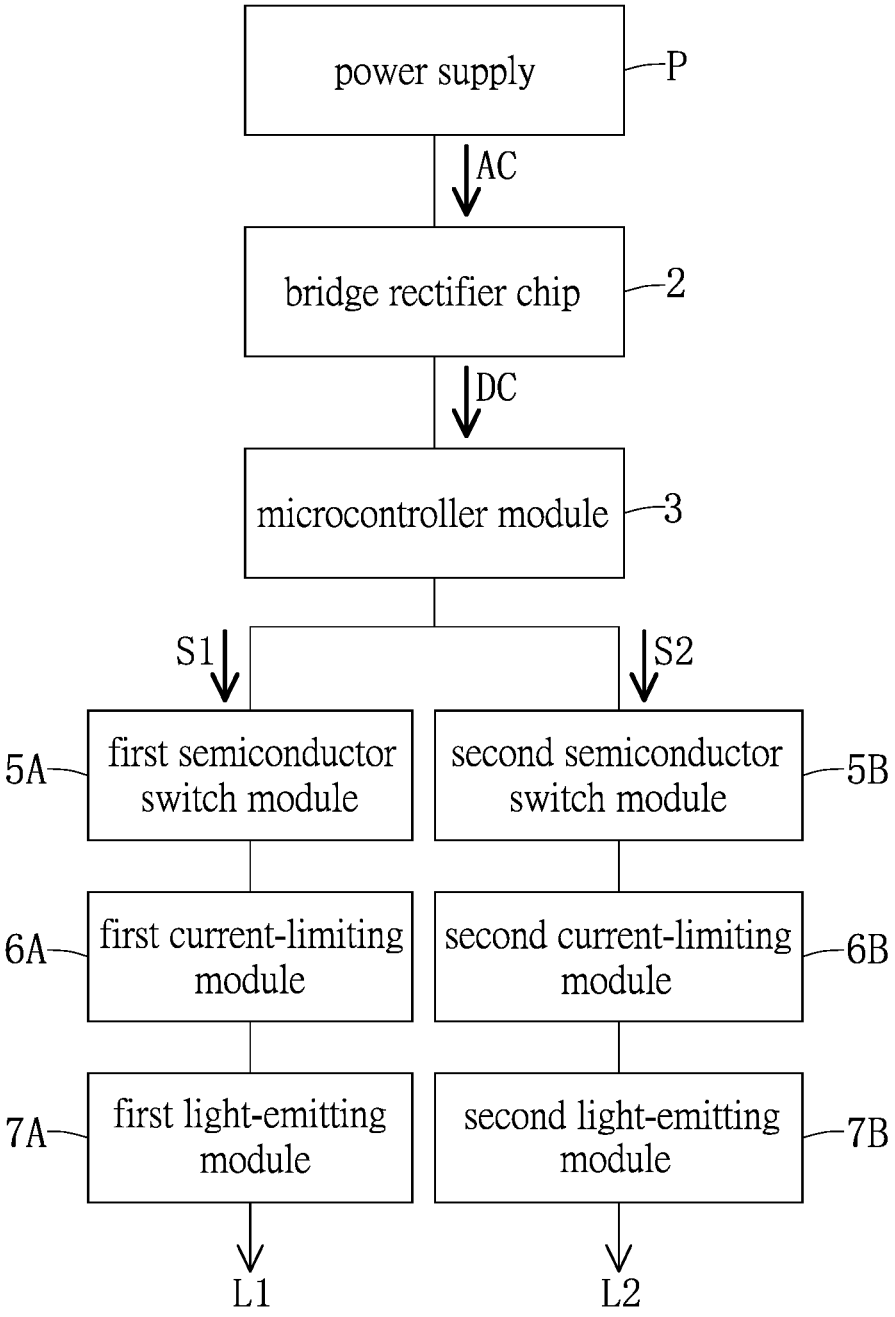
FIG. 3 is a functional block diagram of the LED illumination device according to the first embodiment of the present disclosure.

Firstly, referring to FIG. 1 and FIG. 3, the circuit substrate 1 includes a first AC power input terminal 11 (such as a live wire) and a second AC power input terminal 12 (such as a neutral wire), and both the first AC power input terminal 11 and the second AC power input terminal 12 are configured for receiving an AC power (AC) provided by a power supply P.

Figure 2:
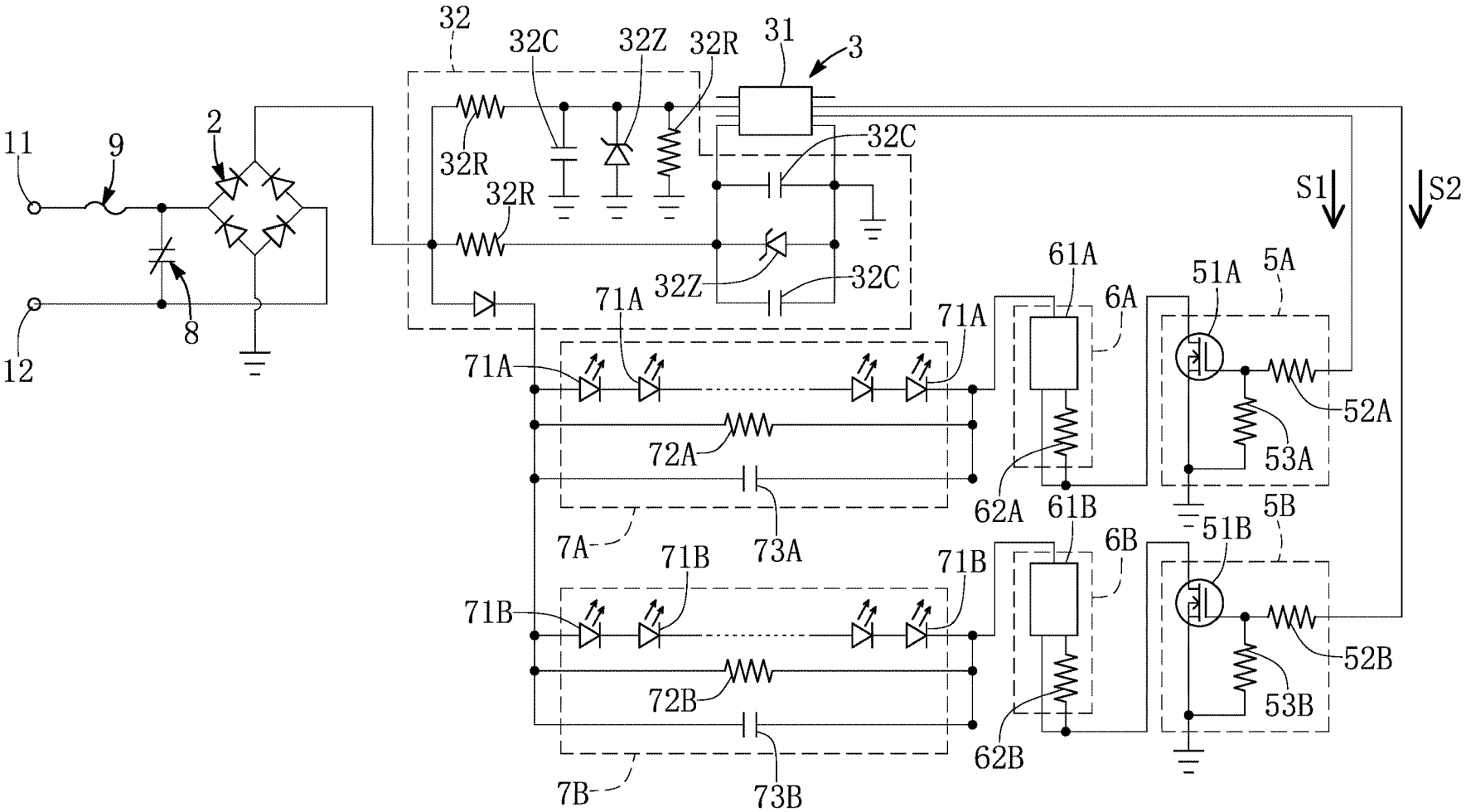
FIG. 2 is a schematic circuit diagram of the LED illumination device according to the first embodiment of the present disclosure.

Furthermore, referring to FIG. 1, FIG. 2 and FIG. 3, the bridge rectifier chip 2 is disposed on the circuit substrate 1 and electrically connected to the circuit substrate 1, and the bridge rectifier chip 2 is electrically connected between the first AC power input terminal 11 and the second AC power input terminal 12 for converting the AC power (AC) into a DC power (DC).

Moreover, referring to FIG. 1, FIG. 2 and FIG. 3, the microcontroller module 3 is disposed on the circuit substrate 1 and electrically connected to the circuit substrate 1. More particularly, the microcontroller module 3 includes a microcontroller chip 31 and a power supply circuit 32 electrically connected to the microcontroller chip 31, and the microcontroller module 3 is electrically connected to the bridge rectifier chip 2 through the power supply circuit 32. For example, the power supply circuit 32 may include a plurality of resistor chips 32R, a plurality of capacitor chips 32C and a plurality of voltage stabilizing diode chips 32Z (or called Zener diodes), or can also be used with other passive components. However, the aforementioned details are disclosed for exemplary purposes only, and are not meant to limit the scope of the present disclosure.

In addition, referring to FIG. 1, FIG. 2 and FIG. 3, the first semiconductor switch module 5A is disposed on the circuit substrate 1 and electrically connected to the circuit substrate 1, and the first semiconductor switch module 5A includes a first semiconductor switch chip 51A for receiving a first pulse width modulation signal S1 (i.e., a first PWM signal) output by the microcontroller chip 31. For example, the first semiconductor switch module 5A includes a first series resistor 52A electrically connected in series to the first semiconductor switch chip 51A, and a first parallel resistor 53A electrically connected in parallel to the first semiconductor switch chip 51A, and the first semiconductor switch chip 51A, the first series resistor 52A and the first parallel resistor 53A can cooperate with each other to serve as a first loop power switch. It is worth mentioning that the first semiconductor switch chip 51A can be a complementary metal-oxide-semiconductor (CMOS) such as NMOS (i.e., n-type MOSFET) or PMOS (i.e., p-type MOSFET). However, the aforementioned details are disclosed for exemplary purposes only, and are not meant to limit the scope of the present disclosure.

Furthermore, referring to FIG. 1, FIG. 2 and FIG. 3, the second semiconductor switch module 5B is disposed on the circuit substrate 1 and electrically connected to the circuit substrate 1, and the second semiconductor switch module 5B includes a second semiconductor switch chip 51B for receiving a second pulse width modulation signal S2 (i.e., a second PWM signal) output by the microcontroller chip 31. For example, the second semiconductor switch module 5B includes a second series resistor 52B electrically connected in series to the second semiconductor switch chip 51B, and a second parallel resistor 53B electrically connected in parallel to the second semiconductor switch chip 51B, and the second semiconductor switch chip 51B, the second series resistor 52B and the second parallel resistor 53B can cooperate with each other to serve as a second loop power switch. It is worth mentioning that the second semiconductor switch chip 51B can be a complementary metal-oxide-semiconductor (CMOS) such as NMOS (i.e., n-type MOSFET) or PMOS (i.e., p-type MOSFET). However, the aforementioned details are disclosed for exemplary purposes only, and are not meant to limit the scope of the present disclosure.

Moreover, referring to FIG. 1, FIG. 2 and FIG. 3, the first current-limiting module 6A is disposed on the circuit substrate 1 and electrically connected to the circuit substrate 1, and the first current-limiting module 6A includes a first current-limiting chip 61A electrically connected to the first semiconductor switch module 5A. In addition, the second current-limiting module 6B is disposed on the circuit substrate 1 and electrically connected to the circuit substrate 1, and the second current-limiting module 6B includes a second current-limiting chip 61B electrically connected to the second semiconductor switch module 5B. For example, the first current-limiting module 6A includes a first current-limiting value adjusting resistor 62A electrically connected to the first current-limiting chip 61A for setting a current-limiting value of the first current-limiting chip 61A (i.e., for setting the amount of current allowed to enter the first light-emitting module 7A through the first current-limiting chip 61A). In addition, the second current-limiting module 6B includes a second current-limiting value adjusting resistor 62B electrically connected to the second current-limiting chip 61B for setting a current-limiting value of the second current-limiting chip 61B (i.e., for setting the amount of current allowed to enter the second light-emitting module 7B through the second current-limiting chip 61B). However, the aforementioned details are disclosed for exemplary purposes only, and are not meant to limit the scope of the present disclosure.

In addition, referring to FIG. 1, FIG. 2 and FIG. 3, the first light-emitting module 7A is disposed on the circuit substrate 1 and electrically connected to the circuit substrate 1, and the first light-emitting module 7A includes a plurality of first LED chips 71A electrically connected between the bridge rectifier chip 2 and the first current-limiting chip 61A. Moreover, the second light-emitting module 7B is disposed on the circuit substrate 1 and electrically connected to the circuit substrate 1, and the second light-emitting module 7B includes a plurality of second LED chips 71B electrically connected between the bridge rectifier chip 2 and the second current-limiting chip 61B. For example, the first light-emitting module 7A includes at least one first resistor chip 72A electrically connected between the bridge rectifier chip 2 and the first current-limiting module 6A, and at least one first capacitor chip 73A electrically connected between the bridge rectifier chip 2 and the first current-limiting module 6A, and each of the first LED chips 71A, the first resistor chip 72A and the first capacitor chip 73A are disposed in parallel with each other. In addition, the second light-emitting module 7B includes at least one second resistor chip 72B electrically connected between the bridge rectifier chip 2 and the second current-limiting module 6B, and at least one second capacitor chip 73B electrically connected between the bridge rectifier chip 2 and the second current-limiting module 6B, and each of the second LED chips 71B, the second resistor chip 72B and the second capacitor chip 73B are disposed in parallel with each other. However, the aforementioned details are disclosed for exemplary purposes only, and are not meant to limit the scope of the present disclosure.

For example, referring to FIG. 1 and FIG. 2, the LED illumination device D provided by the first embodiment of the present disclosure further includes a surge absorber chip 8 (or an anti-surge device, or a varistor) and a fuse chip 9. More particularly, the surge absorber chip 8 is disposed on the circuit substrate 1 and electrically connected to the circuit substrate 1, and the surge absorber chip 8 is electrically connected to the first AC power input terminal 11 and the second AC power input terminal 12 to provide a voltage surge protection between the first AC power input terminal 11 and the second AC power input terminal 12. In addition, the fuse chip 9 is disposed on the circuit substrate 1 and electrically connected to the circuit substrate 1, and the fuse chip 9 is electrically connected to the first AC power input terminal 11 and the bridge rectifier chip 2 to provide a current overload protection for the first AC power input terminal 11. However, the aforementioned details are disclosed for exemplary purposes only, and are not meant to limit the scope of the present disclosure.

For example, referring to FIG. 1, FIG. 2 and FIG. 3, when the AC power (AC) is supplied to the LED illumination device D through the circuit substrate 1, both the first semiconductor switch module 5A and the second semiconductor switch module 5B can be turned on and maintained within a predetermined turn-on percentage range without being completely turned off (or both the first semiconductor switch module 5A and the second semiconductor switch module 5B can be maintained in a turn-on state within a predetermined turn-on percentage range without being completely turned off). That is to say, when the AC power (AC) is supplied to the LED illumination device D through the circuit substrate 1, both the first semiconductor switch module 5A and the second semiconductor switch module 5B can be turned on and maintained within the predetermined turn-on percentage range without being completely turned off, so that both the first capacitor chip 73A and the second capacitor chip 73B are maintained in a fully charged state. It should be noted that when the first semiconductor switch module 5A is turned on 100% (i.e., when the first semiconductor switch module 5A is fully turned on), a first predetermined current can be transmitted to the first light-emitting module 7A through the first semiconductor switch module 5A and the first current-limiting module 6A, thereby supplying the current required by the first light-emitting module 7A. In addition, when the second semiconductor switch module 5B is turned on 100% (i.e., when the second semiconductor switch module 5B is fully turned on), a second predetermined current can be transmitted to the second light-emitting module 7B through the second semiconductor switch module 5B and the second current-limiting module 6B, thereby supplying the current required by the second light-emitting module 7B. However, the aforementioned details are disclosed for exemplary purposes only, and are not meant to limit the scope of the present disclosure.

Figure 7:
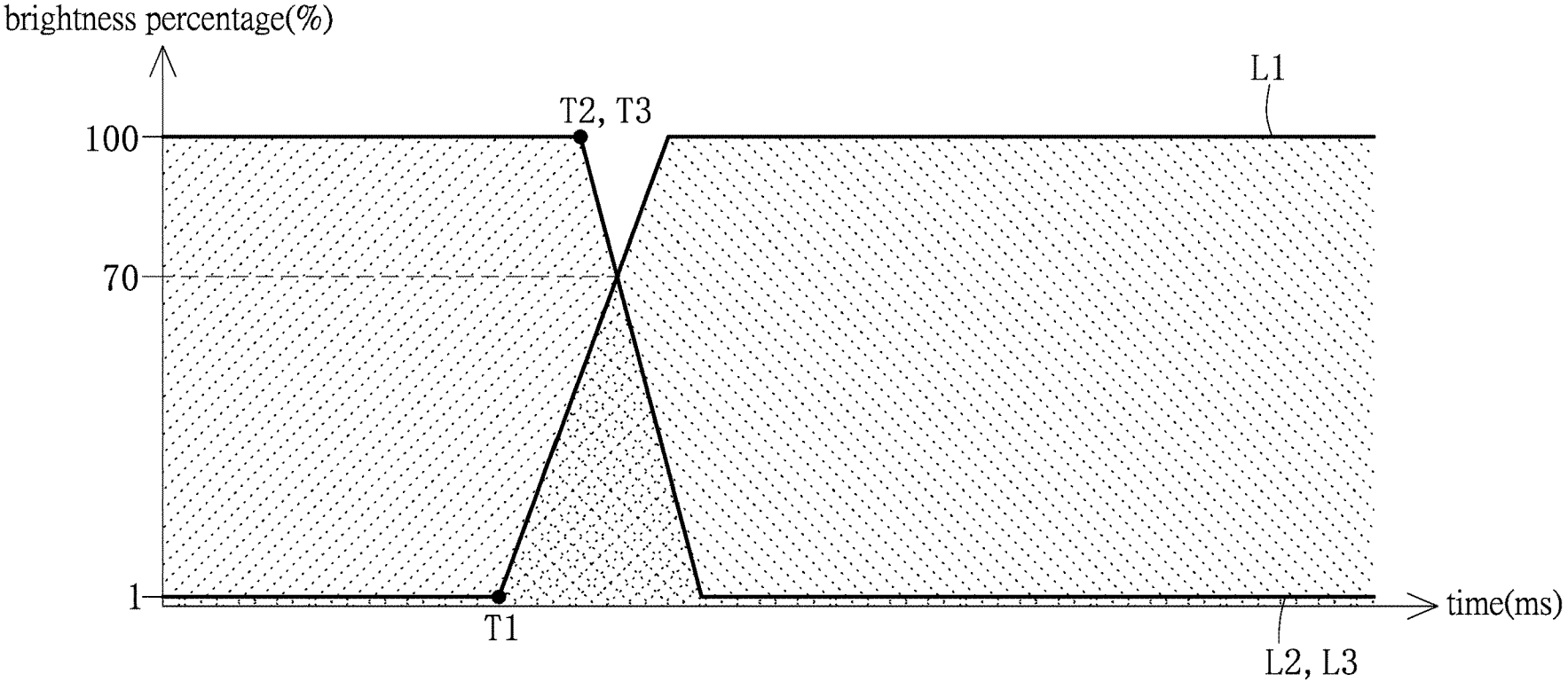
FIG. 7 is a schematic diagram of the corresponding relationship between time and brightness percentage when the LED illumination device performs a color temperature switching provided by the present disclosure (when the first predetermined time point is earlier than the second predetermined time point and the third predetermined time point)

For example, referring to FIG. 2, FIG. 3 and FIG. 7, when the first pulse width modulation signal S1 is transmitted to the first semiconductor switch module 5A at a first predetermined time point T1 through the microcontroller chip 31 of the microcontroller module 3, the first semiconductor switch module can be turned on between a minimum predetermined percentage and 100% (for example, any positive integer percentage between 1% and 100%), so that the first predetermined current between a minimum predetermined percentage and 100% (for example, any positive integer percentage between 1% and 100%) can be correspondingly transmitted to the first light-emitting module 7A through the first semiconductor switch module 5A. In addition, when the second pulse width modulation signal S2 is transmitted to the second semiconductor switch module at a second predetermined time point T2 through the microcontroller chip 31 of the microcontroller module 3, the second semiconductor switch module 5B can be turned on between a minimum predetermined percentage and 100% (for example, any positive integer percentage between 1% and 100%), so that the second predetermined current between a minimum predetermined percentage and 100% (for example, any positive integer percentage between 1% and 100%) can be correspondingly transmitted to the second light-emitting module 7B through the second semiconductor switch module 5B. However, the aforementioned details are disclosed for exemplary purposes only, and are not meant to limit the scope of the present disclosure.

Figure 8:
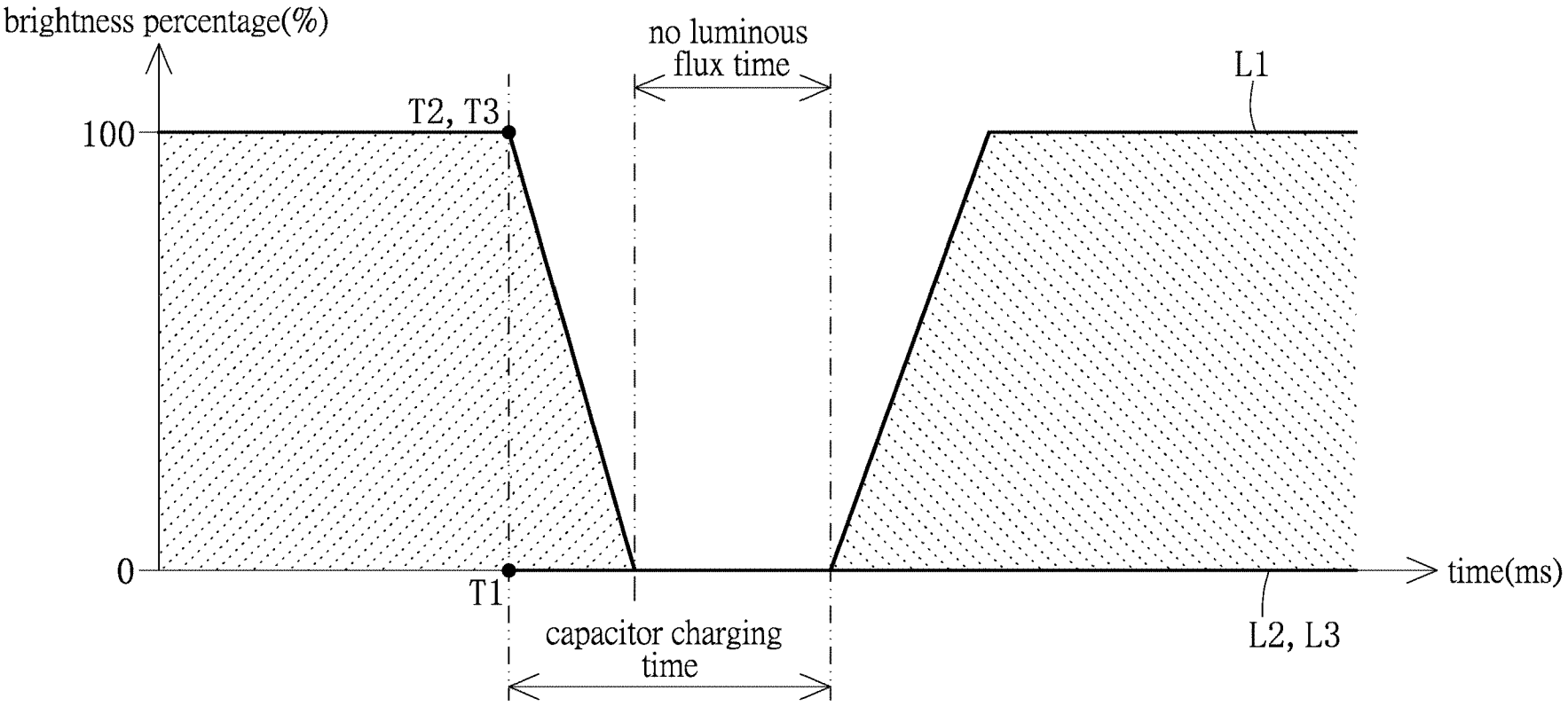
FIG. 8 RELATED ART
FIG. 8 is a schematic diagram of the corresponding relationship between the time and the brightness percentage when the LED illumination device performs the color temperature switching provided by the present disclosure (when the first predetermined time point, the second predetermined time point and the third predetermined time point are the same)

For example, referring to FIG. 2, FIG. 3, FIG. 7 and FIG. 8, when "the first predetermined time point T1 is earlier than the second predetermined time point T2 (for example, the difference between the first predetermined time point T1 and the second predetermined time point T2 ranges from 40 ms to 60 ms, and the range is also the command time difference between the first pulse width modulation signal S1 and the second pulse width modulation signal S2)," "100% of the first predetermined current is transmitted to the first light-emitting module 7A through the first semiconductor switch module 5A (for example, as shown in FIG. 3 and FIG. 7, the first semiconductor switch module 5A can be turned on 100% through the control of the first pulse width modulation signal S1, so that the brightness percentage of the first light-emitting module 7A will be increased from 1% to 100%)," and "the minimum predetermined percentage of the second predetermined current is transmitted to the second light-emitting module 7B through the second semiconductor switch module 5B (for example, as shown in FIG. 3 and FIG. 7, the second semiconductor switch module 5B can be turned on 1% through the control of the second pulse width modulation signal S2, so that the brightness percentage of the second light-emitting module 7B will be reduced from 100% to 1%)," each of the first LED chips 71A can be configured to generate a first predetermined color light source L1 (i.e., a first color temperature light source) with 100% brightness, and each of the second LED chips 71B can be configured to generate a second predetermined color light source L2 (i.e., a second color temperature light source) with a minimum percentage brightness (such as 1% brightness). Therefore, because "the control performed by the first semiconductor switch module 5A through the first pulse width modulation signal S1" is earlier than "the control performed by the second semiconductor switch module 5B through the second pulse width modulation signal S2," before the brightness percentage of the second light-emitting module 7B is reduced from 100% to 1% (such as reduced to 70%), the brightness percentage of the first light-emitting module 7A will increase from 1% to a predetermined brightness percentage (such as increased to 70%), whereby the LED illumination device D provided by the present disclosure can avoid the situation of no luminous flux. For example, as shown in FIG. 8, when the first predetermined time point T1 and the second predetermined time point T2 are the same, the brightness percentage of the first predetermined color light source L1 will start to increase from 0% after waiting for a short period of capacitor charging time, so that when the brightness percentage of the second predetermined color light source L2 is reduced to 0%, a short period of no luminous flux time (i.e., the time when the brightness percentage is 0%) will be generated. However, the aforementioned details are disclosed for exemplary purposes only, and are not meant to limit the scope of the present disclosure.

Figure 9:
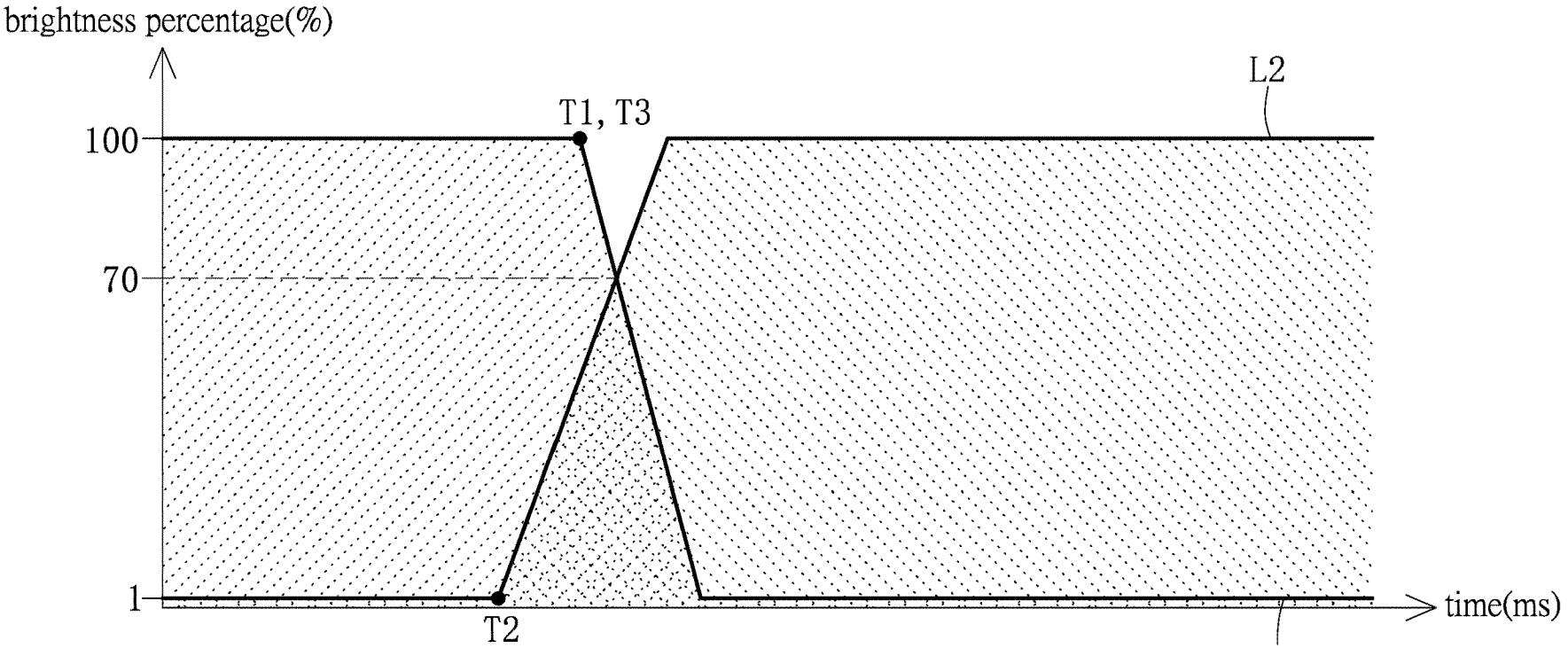
FIG. 9 is a schematic diagram of the corresponding relationship between time and brightness percentage when the LED illumination device performs the color temperature switching provided by the present disclosure (when the second predetermined time point is earlier than the first predetermined time point and the third predetermined time point)

For example, referring to FIG. 2, FIG. 3, FIG. 8 and FIG. 9, when "the second predetermined time point T2 is earlier than the first predetermined time point T1 (for example, the difference between the first predetermined time point T1 and the second predetermined time point T2 ranges from 40 ms to 60 ms, and the range is also the command time difference between the first pulse width modulation signal S1 and the second pulse width modulation signal S2)," "the minimum predetermined percentage of the first predetermined current is transmitted to the first light-emitting module 7A through the first semiconductor switch module 5A (for example, as shown in FIG. 3 and FIG. 9, the first semiconductor switch module 5A can be turned on 1% through the control of the first pulse width modulation signal S1, so that the brightness percentage of the first light-emitting module 7A will be reduced from 100% to 1%)," and "100% of the second predetermined current is transmitted to the second light-emitting module 7B through the second semiconductor switch module 5B (for example, as shown in FIG. 3 and FIG. 9, the second semiconductor switch module 5B can be turned on 100% through the control of the second pulse width modulation signal S2, so that the brightness percentage of the second light-emitting module 7B will be increased from 1% to 100%)," each of the first LED chips 71A can be configured to generate a first predetermined color light source L1 (i.e., a first color temperature light source) with a minimum percentage brightness (such as 1% brightness), and each of the second LED chips 71B can be configured to generate a second predetermined color light source L2 (i.e., a second color temperature light source) with 100% brightness. Therefore, because "the control performed by the second semiconductor switch module 5B through the second pulse width modulation signal S2" is earlier than "the control performed by the first semiconductor switch module 5A through the first pulse width modulation signal S1," before the brightness percentage of the first light-emitting module 7A is reduced from 100% to 1% (such as reduced to 70%), the brightness percentage of the second light-emitting module 7B will increase from 1% to a predetermined brightness percentage (such as increased to 70%), whereby the LED illumination device D provided by the present disclosure can avoid the situation of no luminous flux (the principle of the situation of no luminous flux is the same as that in FIG. 8, and will not be repeated here). However, the aforementioned details are disclosed for exemplary purposes only, and are not meant to limit the scope of the present disclosure.

Second Embodiment

Referring to FIG. 4 to FIG. 6 and FIG. 7 to FIG. 10, a second embodiment of the present disclosure provides an LED illumination device D and a color temperature switching method of the LED illumination device D, and the LED illumination device D includes a circuit substrate 1, a bridge rectifier chip 2, a microcontroller module 3, a first semiconductor switch module 5A, a second semiconductor switch module 5B, a first current-limiting module 6A, a second current-limiting module 6B, a first light-emitting module 7A and a second light-emitting module 7B. From the comparison of FIG. 4 to FIG. 6 with FIG. 1 to FIG. 3 respectively, the main difference between the second embodiment and the first embodiment is as follows: in the second embodiment, the LED illumination device D further includes a third semiconductor switch module 5C, a third current-limiting module 6C and a third light-emitting module 7C.

Figure 4:
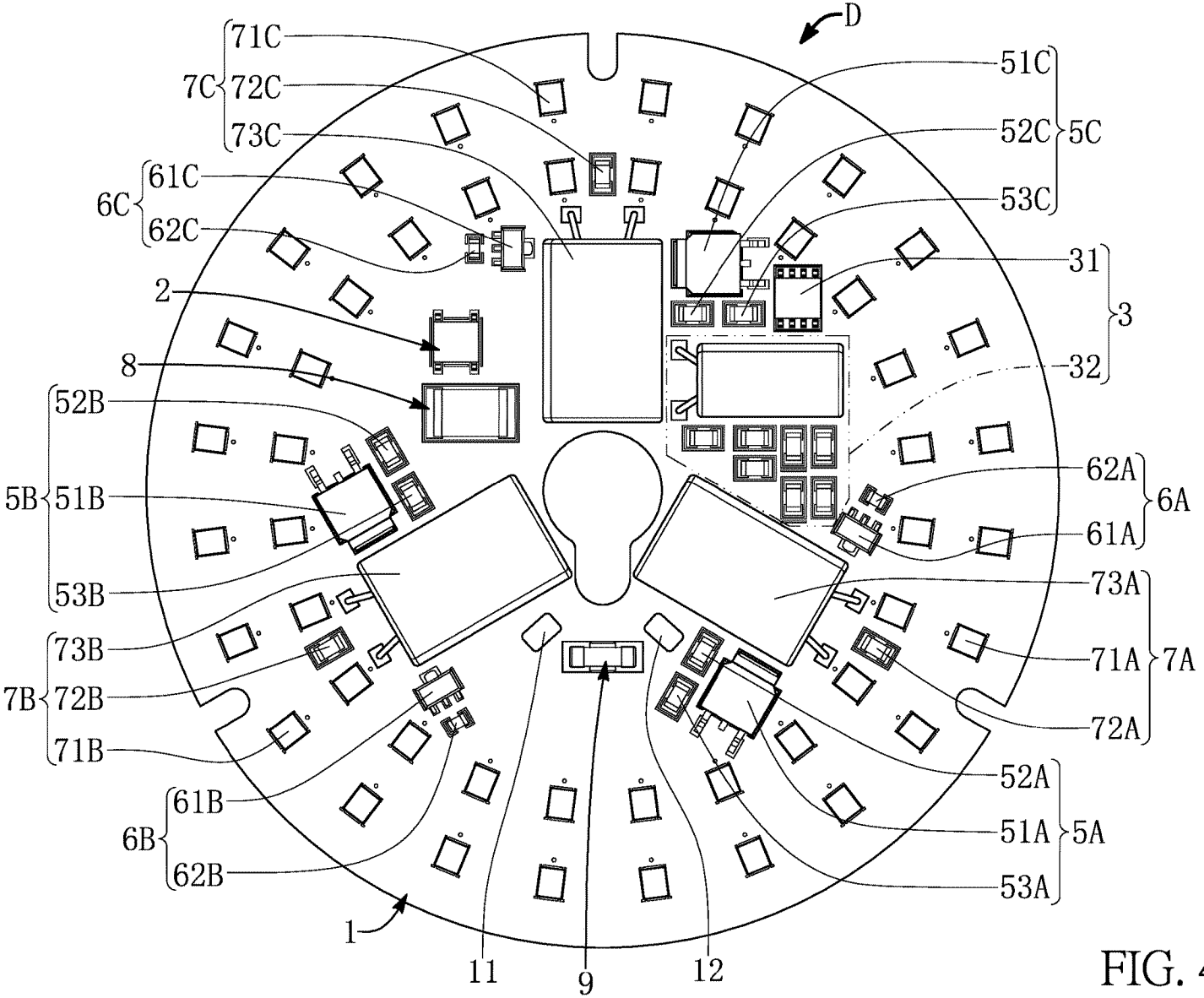
FIG. 4 is a schematic top view of the LED illumination device according to a second embodiment of the present disclosure.
Figure 5:
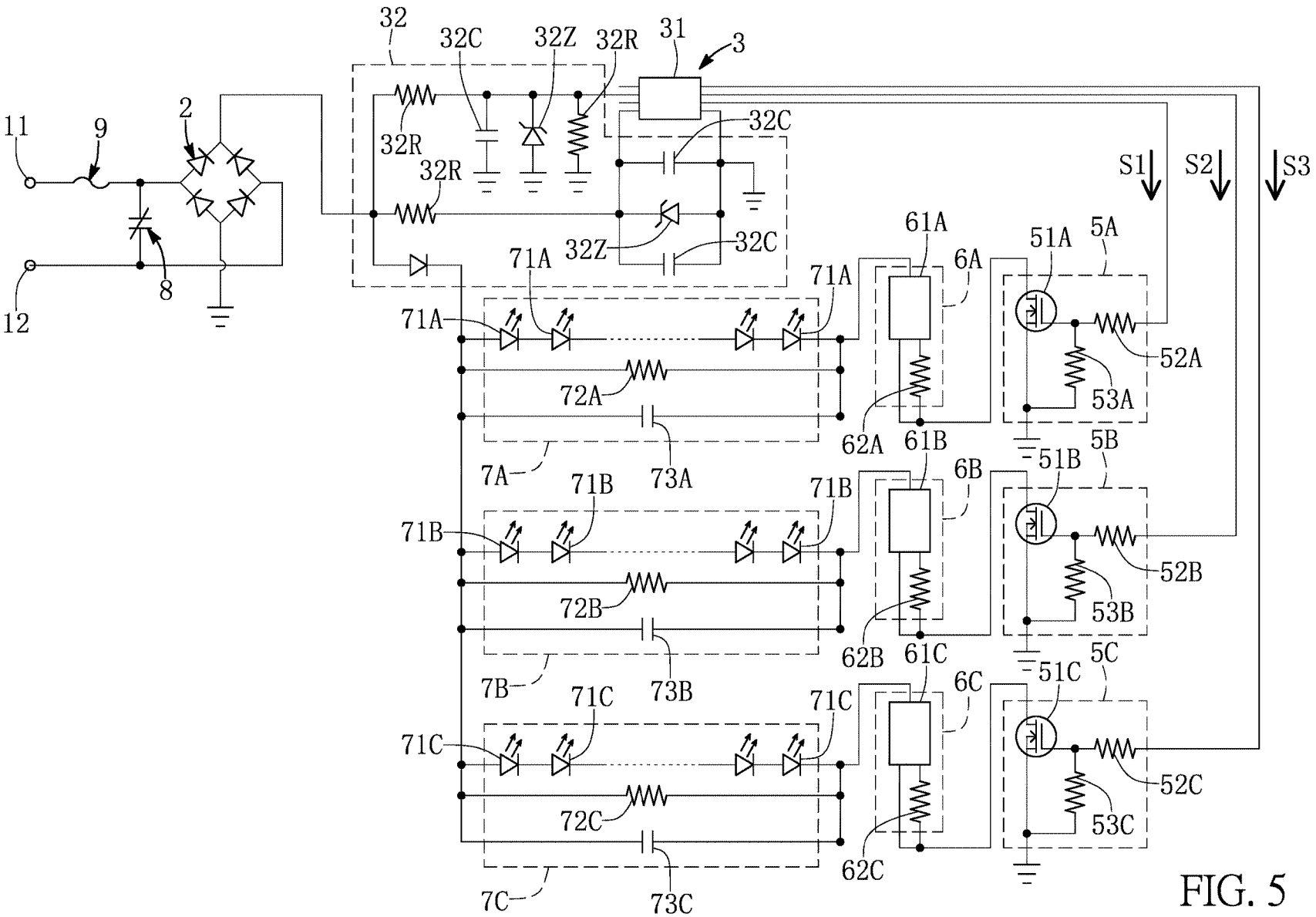
FIG. 5 is a schematic circuit diagram of the LED illumination device according to the second embodiment of the present disclosure.
Figure 6:
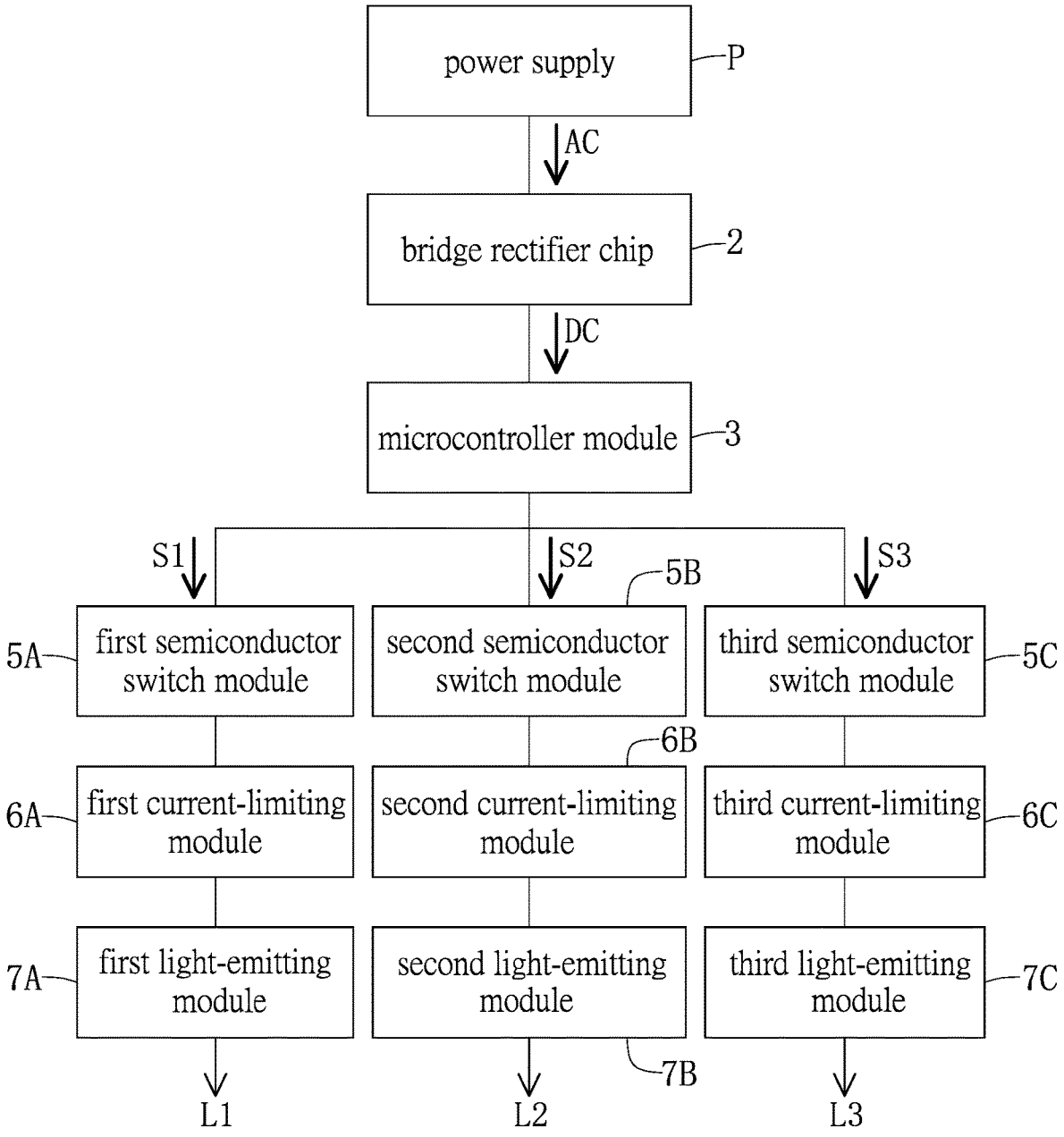
FIG. 6 is a functional block diagram of the LED illumination device according to the second embodiment of the present disclosure.

More particularly, referring to FIG. 4, FIG. 5 and FIG. 6, the third semiconductor switch module 5C is disposed on the circuit substrate 1 and electrically connected to the circuit substrate 1, and the third semiconductor switch module 5C includes a third semiconductor switch chip 51C for receiving a third pulse width modulation signal S3 output by the microcontroller chip 31. Furthermore, the third current-limiting module 6C is disposed on the circuit substrate 1 and electrically connected to the circuit substrate 1, and the third current-limiting module 6C includes a third current-limiting chip 61C electrically connected to the third semiconductor switch module 5C. Moreover, the third light-emitting module 7C is disposed on the circuit substrate 1 and electrically connected to the circuit substrate 1, and the third light-emitting module 7C includes a plurality of third LED chips 71C electrically connected between the bridge rectifier chip 2 and the third current-limiting chip 61C.

For example, referring to FIG. 4, FIG. 5 and FIG. 6, the third semiconductor switch module 5C includes a third series resistor 52C electrically connected in series to the third semiconductor switch chip 51C, and a third parallel resistor 53C electrically connected in parallel to the third semiconductor switch chip 51C, and the third semiconductor switch chip 51C, the third series resistor 52C and the third parallel resistor 53C can cooperate with each other to serve as a third loop power switch. Moreover, the third current-limiting module 6C includes a third current-limiting value adjusting resistor 62C electrically connected to the third current-limiting chip 61C for setting a current-limiting value of the third current-limiting chip 61C. In addition, the third light-emitting module 7C includes a third resistor chip 72C electrically connected between the bridge rectifier chip 2 and the third current-limiting module 6C, and a third capacitor chip 73C electrically connected between the bridge rectifier chip 2 and the third current-limiting module 6C, and each of the third LED chips 71C, the third resistor chip 72C and the third capacitor chip 73C are disposed in parallel with each other. However, the aforementioned details are disclosed for exemplary purposes only, and are not meant to limit the scope of the present disclosure.

Figure 10:
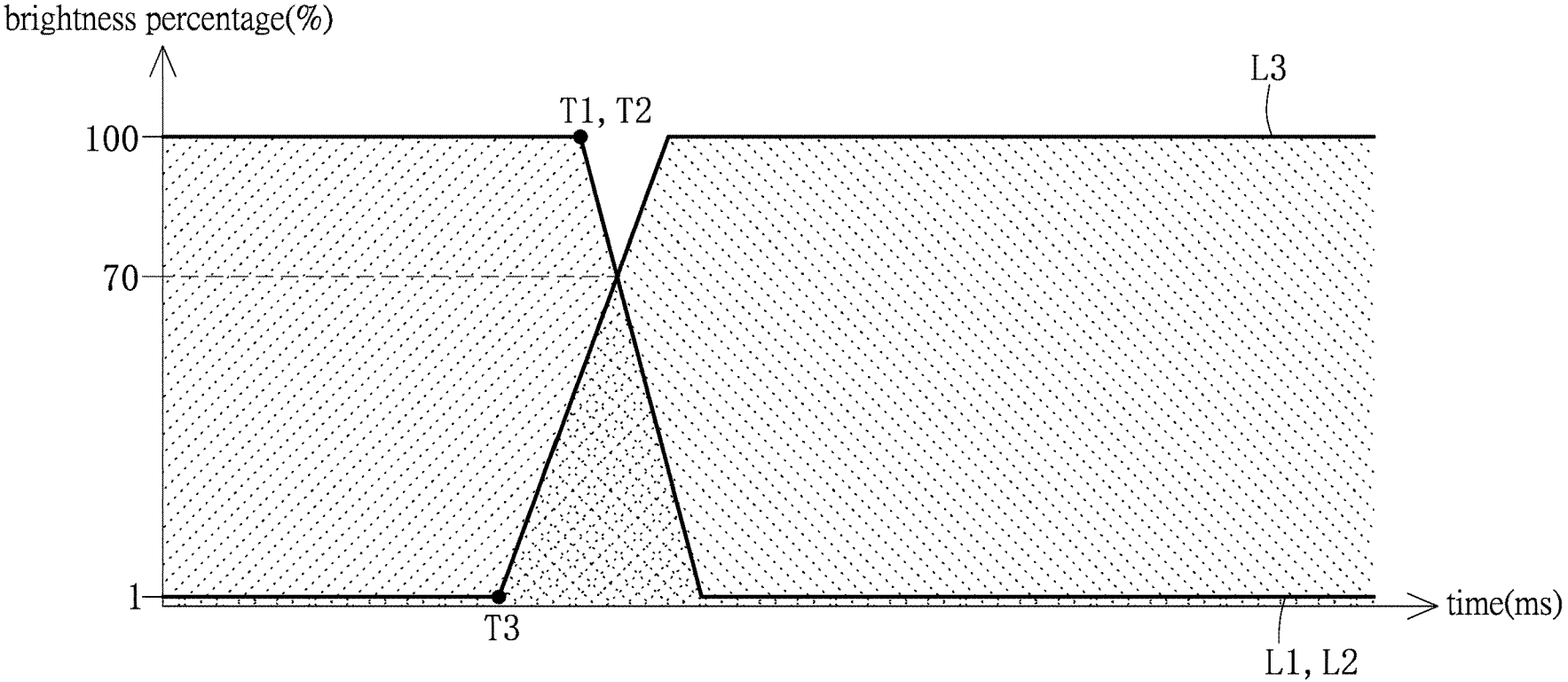
FIG. 10 is a schematic diagram of the corresponding relationship between time and brightness percentage when the LED illumination device performs the color temperature switching provided by the present disclosure (when the third predetermined time point is earlier than the first predetermined time point and the second predetermined time point).

For example, referring to FIG. 5, FIG. 6 and FIG. 10, when the AC power (AC) is supplied to the LED illumination device D through the circuit substrate 1, the third semiconductor switch module 5C can be turned on and maintained within the predetermined turn-on percentage range without being completely turned off (or the third semiconductor switch module 5C can be maintained in a turn-on state within the predetermined turn-on percentage range without being completely turned off). That is to say, when the AC power (AC) is supplied to the LED illumination device D through the circuit substrate 1, the third semiconductor switch module 5C can be turned on and maintained within the predetermined turn-on percentage range without being completely turned off, so that the third capacitor chip 73C is maintained in a fully charged state. It should be noted that when the third semiconductor switch module 5C is turned on 100% (i.e., when the third semiconductor switch module 5C is fully turned on), a third predetermined current is transmitted to the third light-emitting module 7C through the third semiconductor switch module 5C and the third current-limiting module 6C, thereby supplying the current required by the third light-emitting module 7C. Moreover, when the third pulse width modulation signal S3 is transmitted to the third semiconductor switch module 5C at a third predetermined time point T3 through the microcontroller chip 31 of the microcontroller module 3, the third semiconductor switch module 5C can be turned on between a minimum predetermined percentage and 100% (for example, any positive integer percentage between 1% and 100%), so that the third predetermined current between a minimum predetermined percentage and 100% (for example, any positive integer percentage between 1% and 100%) can be correspondingly transmitted to the third light-emitting module 7C through the third semiconductor switch module 5C. However, the aforementioned details are disclosed for exemplary purposes only, and are not meant to limit the scope of the present disclosure.

For example, referring to FIG. 5, FIG. 6, FIG. 7 and FIG. 8, when "the first predetermined time point T1 is earlier than the second predetermined time point T2 and the third predetermined time point T3 (for example, the difference between the first predetermined time point T1 and the second predetermined time point T2 or the third predetermined time point T3 ranges from 40 ms to 60 ms, and the range is also the command time difference between the first pulse width modulation signal S1 and the second pulse width modulation signal S2 or the third pulse width modulation signal S3)," "100% of the first predetermined current is transmitted to the first light-emitting module 7A through the first semiconductor switch module 5A (for example, as shown in FIG. 6 and FIG. 7, the first semiconductor switch module 5A can be turned on 100% through the control of the first pulse width modulation signal S1, so that the brightness percentage of the first light-emitting module 7A will be increased from 1% to 100%)," "the minimum predetermined percentage of the second predetermined current is transmitted to the second light-emitting module 7B through the second semiconductor switch module 5B (for example, as shown in FIG. 6 and FIG. 7, the second semiconductor switch module 5B can be turned on 1% through the control of the second pulse width modulation signal S2, so that the brightness percentage of the second light-emitting module 7B will be reduced from 100% to 1%)," and "the minimum predetermined percentage of the third predetermined current is transmitted to the third light-emitting module 7C through the third semiconductor switch module 5C (for example, as shown in FIG. 6 and FIG. 7, the third semiconductor switch module 5C can be turned on 1% through the control of the third pulse width modulation signal S3, so that the brightness percentage of the third light-emitting module 7C will be reduced from 100% to 1%)," each of the first LED chips 71A can be configured to generate a first predetermined color light source L1 (i.e., a first color temperature light source) with 100% brightness, each of the second LED chips 71B can be configured to generate a second predetermined color light source L2 (i.e., a second color temperature light source) with a minimum percentage brightness (such as 1% brightness), and each of the third LED chips 71C can be configured to generate a third predetermined color light source L3 (i.e., a third color temperature light source) with a minimum percentage brightness (such as 1% brightness). Therefore, because "the control performed by the first semiconductor switch module 5A through the first pulse width modulation signal S1" is earlier than "the control performed by the second semiconductor switch module 5B through the second pulse width modulation signal S2" and "the control performed by the third semiconductor switch module 5C through the third pulse width modulation signal S3," before the brightness percentages of the second light-emitting module 7B and the third light-emitting module 7C are reduced from 100% to 1% (such as reduced to 70%), the brightness percentage of the first light-emitting module 7A will increase from 1% to a predetermined brightness percentage (such as increased to 70%), whereby the LED illumination device D provided by the present disclosure can avoid the situation of no luminous flux. For example, as shown in FIG. 8, when the first predetermined time point T1, the second predetermined time point T2 and the third predetermined time point T3 are the same, the brightness percentage of the first predetermined color light source L1 will start to increase from 0% after waiting for a short period of capacitor charging time, so that when the brightness percentages of the second predetermined color light source L2 and the third predetermined color light source L3 are reduced to 0%, a short period of no luminous flux time (i.e., the time when the brightness percentage is 0%) will be generated. However, the aforementioned details are disclosed for exemplary purposes only, and are not meant to limit the scope of the present disclosure.

For example, referring to FIG. 5, FIG. 6, FIG. 8 and FIG. 9, when "the second predetermined time point T2 is earlier than the first predetermined time point T1 and the third predetermined time point T3 (for example, the difference between the second predetermined time point T2 and the first predetermined time point T1 or the third predetermined time point T3 ranges from 40 ms to 60 ms, and the range is also the command time difference between the second pulse width modulation signal S2 and the first pulse width modulation signal S1 or the third pulse width modulation signal S3)," "the minimum predetermined percentage of the first predetermined current is transmitted to the first light-emitting module 7A through the first semiconductor switch module 5A (for example, as shown in FIG. 6 and FIG. 9, the first semiconductor switch module can be turned on 1% through the control of the first pulse width modulation signal S1, so that the brightness percentage of the first light-emitting module 7A will be reduced from 100% to 1%)," "100% of the second predetermined current is transmitted to the second light-emitting module 7B through the second semiconductor switch module 5B (for example, as shown in FIG. 6 and FIG. 9, the second semiconductor switch module 5B can be turned on 100% through the control of the second pulse width modulation signal S2, so that the brightness percentage of the second light-emitting module 7B will be increased from 1% to 100%)," and "the minimum predetermined percentage of the third predetermined current is transmitted to the third light-emitting module 7C through the third semiconductor switch module 5C (for example, as shown in FIG. 6 and FIG. 9, the third semiconductor switch module 5C can be turned on 1% through the control of the third pulse width modulation signal S3, so that the brightness percentage of the third light-emitting module 7C will be reduced from 100% to 1%)," each of the first LED chips 71A can be configured to generate a first predetermined color light source L1 (i.e., a first color temperature light source) with a minimum percentage brightness (such as 1% brightness), each of the second LED chips 71B can be configured to generate a second predetermined color light source L2 (i.e., a second color temperature light source) with 100% brightness, and each of the third LED chips 71C can be configured to generate a third predetermined color light source L3 (i.e., a third color temperature light source) with a minimum percentage brightness (such as 1% brightness). Therefore, because "the control performed by the second semiconductor switch module 5B through the second pulse width modulation signal S2" is earlier than "the control performed by the first semiconductor switch module 5A through the first pulse width modulation signal S1" and "the control performed by the third semiconductor switch module 5C through the third pulse width modulation signal S3," before the brightness percentages of the first light-emitting module 7A and the third light-emitting module 7C are reduced from 100% to 1% (such as reduced to 70%), the brightness percentage of the second light-emitting module 7B will increase from 1% to a predetermined brightness percentage (such as increased to 70%), whereby the LED illumination device D provided by the present disclosure can avoid the situation of no luminous flux (the principle of the situation of no luminous flux is the same as that in FIG. 8, and will not be repeated here). However, the aforementioned details are disclosed for exemplary purposes only, and are not meant to limit the scope of the present disclosure.

For example, referring to FIG. 5, FIG. 6, FIG. 8 and FIG. 10, when "the third predetermined time point T3 is earlier than the first predetermined time point T1 and the second predetermined time point T2 (for example, the difference between the third predetermined time point T3 and the first predetermined time point T1 or the second predetermined time point T2 ranges from 40 ms to 60 ms, and the range is also the command time difference between the third pulse width modulation signal S3 and the first pulse width modulation signal S1 or the second pulse width modulation signal S2)," "the minimum predetermined percentage of the first predetermined current is transmitted to the first light-emitting module 7A through the first semiconductor switch module 5A (for example, as shown in FIG. 6 and FIG. 9, the first semiconductor switch module 5A can be turned on 1% through the control of the first pulse width modulation signal S1, so that the brightness percentage of the first light-emitting module 7A will be reduced from 100% to 1%)," "the minimum predetermined percentage of the second predetermined current is transmitted to the second light-emitting module 7B through the second semiconductor switch module 5B (for example, as shown in FIG. 6 and FIG. 10, the second semiconductor switch module 5B can be turned on 1% through the control of the second pulse width modulation signal S2, so that the brightness percentage of the second light-emitting module 7B will be reduced from 100% to 1%)," and "100% of the third predetermined current is transmitted to the third light-emitting module 7C through the third semiconductor switch module 5C (for example, as shown in FIG. 6 and FIG. 10, the third semiconductor switch module 5C can be turned on 100% through the control of the third pulse width modulation signal S3, so that the brightness percentage of the third light-emitting module 7C will be increased from 1% to 100%)," each of the first LED chips 71A can be configured to generate a first predetermined color light source L1 (i.e., a first color temperature light source) with a minimum percentage brightness (such as 1% brightness), each of the second LED chips 71B can be configured to generate a second predetermined color light source L2 (i.e., a second color temperature light source) with a minimum percentage brightness (such as 1% brightness), and each of the third LED chips 71C can be configured to generate a third predetermined color light source L3 (i.e., a third color temperature light source) 100% brightness. Therefore, because "the control performed by the third semiconductor switch module 5C through the third pulse width modulation signal S3" is earlier than "the control performed by the first semiconductor switch module 5A through the first pulse width modulation signal S1" and "the control performed by the second semiconductor switch module 5B through the second pulse width modulation signal S2," before the brightness percentages of the first light-emitting module 7A and the second light-emitting module 7B are reduced from 100% to 1% (such as reduced to 70%), the brightness percentage of the third light-emitting module 7C will increase from 1% to a predetermined brightness percentage (such as increased to 70%), whereby the LED illumination device D provided by the present disclosure can avoid the situation of no luminous flux (the principle of the situation of no luminous flux is the same as that in FIG. 8, and will not be repeated here). However, the aforementioned details are disclosed for exemplary purposes only, and are not meant to limit the scope of the present disclosure.

Beneficial Effects of the Embodiments

In conclusion, in the LED illumination device D and the color temperature switching method provided by the present disclosure, by virtue of "the microcontroller module 3 including a microcontroller chip 31 and a power supply circuit 32 electrically connected to the microcontroller chip 31," "the first semiconductor switch module 5A including a first semiconductor switch chip 51A for receiving a first pulse width modulation signal S1 output by the microcontroller chip 31," "the second semiconductor switch module 5B including a second semiconductor switch chip 51B for receiving a second pulse width modulation signal S2 output by the microcontroller chip 31," "the first current-limiting module 6A including a first current-limiting chip 61A electrically connected to the first semiconductor switch module 5A," "the second current-limiting module 6B including a second current-limiting chip 61B electrically connected to the second semiconductor switch module 5B," "the first light-emitting module 7A including a plurality of first LED chips 71A electrically connected between the bridge rectifier chip 2 and the first current-limiting chip 61A" and "the second light-emitting module 7B including a plurality of second LED chips 71B electrically connected between the bridge rectifier chip 2 and the second current-limiting chip 61B," when an AC power (AC) is supplied to the LED illumination device D through the circuit substrate 1, both the first semiconductor switch module 5A and the second semiconductor switch module 5B are turned on and maintained within a predetermined turn-on percentage range (for example, it can range from 1% to 100%, or it can also be a possible range between 0.1% and 100%) without being completely turned off.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An LED illumination device, comprising:

a circuit substrate including a first AC power input terminal and a second AC power input terminal, wherein both the first AC power input terminal and the second AC power input terminal are configured for receiving an AC power;

a bridge rectifier chip disposed on the circuit substrate and electrically connected to the circuit substrate, wherein the bridge rectifier chip is electrically connected between the first AC power input terminal and the second AC power input terminal for converting the AC power into a DC power;

a microcontroller module disposed on the circuit substrate and electrically connected to the circuit substrate, wherein the microcontroller module includes a microcontroller chip and a power supply circuit electrically connected to the microcontroller chip, the microcontroller module is electrically connected to the bridge rectifier chip through the power supply circuit, and the power supply circuit includes a plurality of resistor chips, a plurality of capacitor chips and a plurality of voltage stabilizing diode chips;

a first semiconductor switch module disposed on the circuit substrate and electrically connected to the circuit substrate, wherein the first semiconductor switch module includes a first semiconductor switch chip for receiving a first pulse width modulation signal output by the microcontroller chip;

a second semiconductor switch module disposed on the circuit substrate and electrically connected to the circuit substrate, wherein the second semiconductor switch module includes a second semiconductor switch chip for receiving a second pulse width modulation signal output by the microcontroller chip;

a first current-limiting module disposed on the circuit substrate and electrically connected to the circuit substrate, wherein the first current-limiting module includes a first current-limiting chip electrically connected to the first semiconductor switch module;

a second current-limiting module disposed on the circuit substrate and electrically connected to the circuit substrate, wherein the second current-limiting module includes a second current-limiting chip electrically connected to the second semiconductor switch module;

a first light-emitting module disposed on the circuit substrate and electrically connected to the circuit substrate, wherein the first light-emitting module includes a plurality of first LED chips electrically connected between the bridge rectifier chip and the first current-limiting chip; and a second light-emitting module disposed on the circuit substrate and electrically connected to the circuit substrate, wherein the second light-emitting module includes a plurality of second LED chips electrically connected between the bridge rectifier chip and the second current-limiting chip;

wherein, when the AC power is supplied to the LED illumination device through the circuit substrate, both the first semiconductor switch module and the second semiconductor switch module are turned on and maintained within a predetermined turn-on percentage range without being completely turned off;

wherein, when the first semiconductor switch module is turned on 100%, a first predetermined current is transmitted to the first light-emitting module through the first semiconductor switch module and the first current-limiting module;

wherein, when the second semiconductor switch module is turned on 100%, a second predetermined current is transmitted to the second light-emitting module through the second semiconductor switch module and the second current-limiting module;

wherein, when the first pulse width modulation signal is transmitted to the first semiconductor switch module at a first predetermined time point through the microcontroller chip of the microcontroller module, the first semiconductor switch module is turned on between a minimum predetermined percentage and 100%, so that the first predetermined current between a minimum predetermined percentage and 100% is correspondingly transmitted to the first light-emitting module through the first semiconductor switch module;

wherein, when the second pulse width modulation signal is transmitted to the second semiconductor switch module at a second predetermined time point through the microcontroller chip of the microcontroller module, the second semiconductor switch module is turned on between a minimum predetermined percentage and 100%, so that the second predetermined current between a minimum predetermined percentage and 100% is correspondingly transmitted to the second light-emitting module through the second semiconductor switch module;

wherein, when the first predetermined time point is earlier than the second predetermined time point, 100% of the first predetermined current is transmitted to the first light-emitting module through the first semiconductor switch module, and the minimum predetermined percentage of the second predetermined current is transmitted to the second light-emitting module through the second semiconductor switch module, each of the first LED chips is configured to generate a first predetermined color light source with 100% brightness, and each of the second LED chips is configured to generate a second predetermined color light source with a minimum percentage brightness;

wherein, when the second predetermined time point is earlier than the first predetermined time point, the minimum predetermined percentage of the first predetermined current is transmitted to the first light-emitting module through the first semiconductor switch module, and 100% of the second predetermined current is transmitted to the second light-emitting module through the second semiconductor switch module, each of the first LED chips is configured to generate a first predetermined color light source with a minimum percentage brightness, and each of the second LED chips is configured to generate a second predetermined color light source with 100% brightness.

2. The LED illumination device according to claim 1, further comprising:

a surge absorber chip disposed on the circuit substrate and electrically connected to the circuit substrate, wherein the surge absorber chip is electrically connected to the first AC power input terminal and the second AC power input terminal to provide a voltage surge protection between the first AC power input terminal and the second AC power input terminal; and a fuse chip disposed on the circuit substrate and electrically connected to the circuit substrate, wherein the fuse chip is electrically connected to the first AC power input terminal and the bridge rectifier chip;

wherein the first semiconductor switch module includes a first series resistor electrically connected in series to the first semiconductor switch chip, and a first parallel resistor electrically connected in parallel to the first semiconductor switch chip, and the first semiconductor switch chip, the first series resistor and the first parallel resistor cooperate with each other to serve as a first loop power switch;

wherein the second semiconductor switch module includes a second series resistor electrically connected in series to the second semiconductor switch chip, and a second parallel resistor electrically connected in parallel to the second semiconductor switch chip, and the second semiconductor switch chip, the second series resistor and the second parallel resistor cooperate with each other to serve as a second loop power switch;

wherein the first current-limiting module includes a first current-limiting value adjusting resistor electrically connected to the first current-limiting chip for setting a current-limiting value of the first current-limiting chip;

wherein the second current-limiting module includes a second current-limiting value adjusting resistor electrically connected to the second current-limiting chip for setting a current-limiting value of the second current-limiting chip;

wherein the first light-emitting module includes a first resistor chip electrically connected between the bridge rectifier chip and the first current-limiting module, and a first capacitor chip electrically connected between the bridge rectifier chip and the first current-limiting module, and each of the first LED chips, the first resistor chip and the first capacitor chip are disposed in parallel with each other;

wherein the second light-emitting module includes a second resistor chip electrically connected between the bridge rectifier chip and the second current-limiting module, and a second capacitor chip electrically connected between the bridge rectifier chip and the second current-limiting module, and each of the second LED chips, the second resistor chip and the second capacitor chip are disposed in parallel with each other;

wherein, when the AC power is supplied to the LED illumination device through the circuit substrate, both the first semiconductor switch module and the second semiconductor switch module are turned on and maintained within the predetermined turn-on percentage range without being completely turned off, so that both the first capacitor chip and the second capacitor chip are maintained in a fully charged state.

3. The LED illumination device according to claim 1, further comprising:

a third semiconductor switch module disposed on the circuit substrate and electrically connected to the circuit substrate, wherein the third semiconductor switch module includes a third semiconductor switch chip for receiving a third pulse width modulation signal output by the microcontroller chip;

a third current-limiting module disposed on the circuit substrate and electrically connected to the circuit substrate, wherein the third current-limiting module includes a third current-limiting chip electrically connected to the third semiconductor switch module; and a third light-emitting module disposed on the circuit substrate and electrically connected to the circuit substrate, wherein the third light-emitting module includes a plurality of third LED chips electrically connected between the bridge rectifier chip and the third current-limiting chip;

wherein, when the AC power is supplied to the LED illumination device through the circuit substrate, the third semiconductor switch module is turned on and maintained within the predetermined turn-on percentage range without being completely turned off;

wherein, when the third semiconductor switch module is turned on 100%, a third predetermined current is transmitted to the third light-emitting module through the third semiconductor switch module and the third current-limiting module;

wherein, when the third pulse width modulation signal is transmitted to the third semiconductor switch module at a third predetermined time point through the microcontroller chip of the microcontroller module, the third semiconductor switch module is turned on between a minimum predetermined percentage and 100%, so that the third predetermined current between a minimum predetermined percentage and 100% is correspondingly transmitted to the third light-emitting module through the third semiconductor switch module;

wherein, when the first predetermined time point is earlier than the second predetermined time point and the third predetermined time point, 100% of the first predetermined current is transmitted to the first light-emitting module through the first semiconductor switch module, the minimum predetermined percentage of the second predetermined current is transmitted to the second light-emitting module through the second semiconductor switch module, and the minimum predetermined percentage of the third predetermined current is transmitted to the third light-emitting module through the third semiconductor switch module, each of the first LED chips is configured to generate a first predetermined color light source with 100% brightness, each of the second LED chips is configured to generate a second predetermined color light source with a minimum percentage brightness, and each of the third LED chips is configured to generate a third predetermined color light source with a minimum percentage brightness;

wherein, when the second predetermined time point is earlier than the first predetermined time point and the third predetermined time point, the minimum predetermined percentage of the first predetermined current is transmitted to the first light-emitting module through the first semiconductor switch module, 100% of the second predetermined current is transmitted to the second light-emitting module through the second semiconductor switch module, and the minimum predetermined percentage of the third predetermined current is transmitted to the third light-emitting module through the third semiconductor switch module, each of the first LED chips is configured to generate a first predetermined color light source with a minimum percentage brightness, each of the second LED chips is configured to generate a second predetermined color light source with 100% brightness, and each of the third LED chips is configured to generate a third predetermined color light source with a minimum percentage brightness;

wherein, when the third predetermined time point is earlier than the first predetermined time point and the second predetermined time point, the minimum predetermined percentage of the first predetermined current is transmitted to the first light-emitting module through the first semiconductor switch module, the minimum predetermined percentage of the second predetermined current is transmitted to the second light-emitting module through the second semiconductor switch module, and 100% of the third predetermined current is transmitted to the third light-emitting module through the third semiconductor switch module, each of the first LED chips is configured to generate a first predetermined color light source with a minimum percentage brightness, each of the second LED chips is configured to generate a second predetermined color light source with a minimum percentage brightness, and each of the third LED chips is configured to generate a third predetermined color light source with 100% brightness.

4. The LED illumination device according to claim 3, wherein the third semiconductor switch module includes a third series resistor electrically connected in series to the third semiconductor switch chip, and a third parallel resistor electrically connected in parallel to the third semiconductor switch chip, and the third semiconductor switch chip, the third series resistor and the third parallel resistor cooperate with each other to serve as a third loop power switch;

wherein the third current-limiting module includes a third current-limiting value adjusting resistor electrically connected to the third current-limiting chip for setting a current-limiting value of the third current-limiting chip;

wherein the third light-emitting module includes a third resistor chip electrically connected between the bridge rectifier chip and the third current-limiting module, and a third capacitor chip electrically connected between the bridge rectifier chip and the third current-limiting module, and each of the third LED chips, the third resistor chip and the third capacitor chip are disposed in parallel with each other;

wherein, when the AC power is supplied to the LED illumination device through the circuit substrate, the third semiconductor switch module is turned on and maintained within the predetermined turn-on percentage range without being completely turned off, so that the third capacitor chip is maintained in a fully charged state.

5. An LED illumination device, comprising:

a circuit substrate including a first AC power input terminal and a second AC power input terminal;

a bridge rectifier chip electrically connected between the first AC power input terminal and the second AC power input terminal;

a microcontroller module including a microcontroller chip and a power supply circuit electrically connected to the microcontroller chip, and the microcontroller module is electrically connected to the bridge rectifier chip through the power supply circuit;

a first semiconductor switch module including a first semiconductor switch chip for receiving a first pulse width modulation signal output by the microcontroller chip;

a second semiconductor switch module including a second semiconductor switch chip for receiving a second pulse width modulation signal output by the microcontroller chip;

a first current-limiting module including a first current-limiting chip electrically connected to the first semiconductor switch module;

a second current-limiting module including a second current-limiting chip electrically connected to the second semiconductor switch module;

a first light-emitting module including a plurality of first LED chips electrically connected between the bridge rectifier chip and the first current-limiting chip; and a second light-emitting module including a plurality of second LED chips electrically connected between the bridge rectifier chip and the second current-limiting chip;

wherein, when an AC power is supplied to the LED illumination device through the circuit substrate, both the first semiconductor switch module and the second semiconductor switch module are turned on and maintained within a predetermined turn-on percentage range without being completely turned off.

6. The LED illumination device according to claim 5, further comprising:

a surge absorber chip electrically connected to the first AC power input terminal and the second AC power input terminal; and a fuse chip electrically connected to the first AC power input terminal and the bridge rectifier chip;

wherein the first semiconductor switch module includes a first series resistor electrically connected in series to the first semiconductor switch chip, and a first parallel resistor electrically connected in parallel to the first semiconductor switch chip, and the first semiconductor switch chip, the first series resistor and the first parallel resistor cooperate with each other to serve as a first loop power switch;

wherein the second semiconductor switch module includes a second series resistor electrically connected in series to the second semiconductor switch chip, and a second parallel resistor electrically connected in parallel to the second semiconductor switch chip, and the second semiconductor switch chip, the second series resistor and the second parallel resistor cooperate with each other to serve as a second loop power switch;

wherein the first current-limiting module includes a first current-limiting value adjusting resistor electrically connected to the first current-limiting chip for setting a current-limiting value of the first current-limiting chip;

wherein the second current-limiting module includes a second current-limiting value adjusting resistor electrically connected to the second current-limiting chip for setting a current-limiting value of the second current-limiting chip;

wherein the first light-emitting module includes a first resistor chip electrically connected between the bridge rectifier chip and the first current-limiting module, and a first capacitor chip electrically connected between the bridge rectifier chip and the first current-limiting module, and each of the first LED chips, the first resistor chip and the first capacitor chip are disposed in parallel with each other;

wherein the second light-emitting module includes a second resistor chip electrically connected between the bridge rectifier chip and the second current-limiting module, and a second capacitor chip electrically connected between the bridge rectifier chip and the second current-limiting module, and each of the second LED chips, the second resistor chip and the second capacitor chip are disposed in parallel with each other;

wherein, when the AC power is supplied to the LED illumination device through the circuit substrate, both the first semiconductor switch module and the second semiconductor switch module are turned on and maintained within the predetermined turn-on percentage range without being completely turned off, so that both the first capacitor chip and the second capacitor chip are maintained in a fully charged state.

7. The LED illumination device according to claim 5, wherein, when the first semiconductor switch module is turned on 100%, a first predetermined current is transmitted to the first light-emitting module through the first semiconductor switch module and the first current-limiting module;

wherein, when the second semiconductor switch module is turned on 100%, a second predetermined current is transmitted to the second light-emitting module through the second semiconductor switch module and the second current-limiting module;

wherein, when the first pulse width modulation signal is transmitted to the first semiconductor switch module at a first predetermined time point through the microcontroller chip of the microcontroller module, the first semiconductor switch module is turned on between a minimum predetermined percentage and 100%, so that the first predetermined current between a minimum predetermined percentage and 100% is correspondingly transmitted to the first light-emitting module through the first semiconductor switch module;

wherein, when the second pulse width modulation signal is transmitted to the second semiconductor switch module at a second predetermined time point through the microcontroller chip of the microcontroller module, the second semiconductor switch module is turned on between a minimum predetermined percentage and 100%, so that the second predetermined current between a minimum predetermined percentage and 100% is correspondingly transmitted to the second light-emitting module through the second semiconductor switch module;

wherein, when the first predetermined time point is earlier than the second predetermined time point, 100% of the first predetermined current is transmitted to the first light-emitting module through the first semiconductor switch module, and the minimum predetermined percentage of the second predetermined current is transmitted to the second light-emitting module through the second semiconductor switch module, each of the first LED chips is configured to generate a first predetermined color light source with 100% brightness, and each of the second LED chips is configured to generate a second predetermined color light source with a minimum percentage brightness;

wherein, when the second predetermined time point is earlier than the first predetermined time point, the minimum predetermined percentage of the first predetermined current is transmitted to the first light-emitting module through the first semiconductor switch module, and 100% of the second predetermined current is transmitted to the second light-emitting module through the second semiconductor switch module, each of the first LED chips is configured to generate a first predetermined color light source with a minimum percentage brightness, and each of the second LED chips is configured to generate a second predetermined color light source with 100% brightness.

8. The LED illumination device according to claim 7, further comprising:

a third semiconductor switch module including a third semiconductor switch chip for receiving a third pulse width modulation signal output by the microcontroller chip;

a third current-limiting module including a third current-limiting chip electrically connected to the third semiconductor switch module; and a third light-emitting module including a plurality of third LED chips electrically connected between the bridge rectifier chip and the third current-limiting chip;

wherein, when the AC power is supplied to the LED illumination device through the circuit substrate, the third semiconductor switch module is turned on and maintained within the predetermined turn-on percentage range without being completely turned off;

wherein, when the third semiconductor switch module is turned on 100%, a third predetermined current is transmitted to the third light-emitting module through the third semiconductor switch module and the third current-limiting module;

wherein, when the third pulse width modulation signal is transmitted to the third semiconductor switch module at a third predetermined time point through the microcontroller chip of the microcontroller module, the third semiconductor switch module is turned on between a minimum predetermined percentage and 100%, so that the third predetermined current between a minimum predetermined percentage and 100% is correspondingly transmitted to the third light-emitting module through the third semiconductor switch module;

wherein, when the first predetermined time point is earlier than the second predetermined time point and the third predetermined time point, 100% of the first predetermined current is transmitted to the first light-emitting module through the first semiconductor switch module, the minimum predetermined percentage of the second predetermined current is transmitted to the second light-emitting module through the second semiconductor switch module, and the minimum predetermined percentage of the third predetermined current is transmitted to the third light-emitting module through the third semiconductor switch module, each of the first LED chips is configured to generate a first predetermined color light source with 100% brightness, each of the second LED chips is configured to generate a second predetermined color light source with a minimum percentage brightness, and each of the third LED chips is configured to generate a third predetermined color light source with a minimum percentage brightness;

wherein, when the second predetermined time point is earlier than the first predetermined time point and the third predetermined time point, the minimum predetermined percentage of the first predetermined current is transmitted to the first light-emitting module through the first semiconductor switch module, 100% of the second predetermined current is transmitted to the second light-emitting module through the second semiconductor switch module, and the minimum predetermined percentage of the third predetermined current is transmitted to the third light-emitting module through the third semiconductor switch module, each of the first LED chips is configured to generate a first predetermined color light source with a minimum percentage brightness, each of the second LED chips is configured to generate a second predetermined color light source with 100% brightness, and each of the third LED chips is configured to generate a third predetermined color light source with a minimum percentage brightness;

wherein, when the third predetermined time point is earlier than the first predetermined time point and the second predetermined time point, the minimum predetermined percentage of the first predetermined current is transmitted to the first light-emitting module through the first semiconductor switch module, the minimum predetermined percentage of the second predetermined current is transmitted to the second light-emitting module through the second semiconductor switch module, and 100% of the third predetermined current is transmitted to the third light-emitting module through the third semiconductor switch module, each of the first LED chips is configured to generate a first predetermined color light source with a minimum percentage brightness, each of the second LED chips is configured to generate a second predetermined color light source with a minimum percentage brightness, and each of the third LED chips is configured to generate a third predetermined color light source with 100% brightness.

9. The LED illumination device according to claim 8, wherein the third semiconductor switch module includes a third series resistor electrically connected in series to the third semiconductor switch chip, and a third parallel resistor electrically connected in parallel to the third semiconductor switch chip, and the third semiconductor switch chip, the third series resistor and the third parallel resistor cooperate with each other to serve as a third loop power switch;

wherein the third current-limiting module includes a third current-limiting value adjusting resistor electrically connected to the third current-limiting chip for setting a current-limiting value of the third current-limiting chip;

wherein the third light-emitting module includes a third resistor chip electrically connected between the bridge rectifier chip and the third current-limiting module, and a third capacitor chip electrically connected between the bridge rectifier chip and the third current-limiting module, and each of the third LED chips, the third resistor chip and the third capacitor chip are disposed in parallel with each other;

wherein, when the AC power is supplied to the LED illumination device through the circuit substrate, the third semiconductor switch module is turned on and maintained within the predetermined turn-on percentage range without being completely turned off, so that the third capacitor chip is maintained in a fully charged state.

10. A color temperature switching method of the LED illumination device as claimed in claim 5, wherein, when the AC power is supplied to the LED illumination device through the circuit substrate, both the first semiconductor switch module and the second semiconductor switch module are turned on and maintained within the predetermined turn-on percentage range without being completely turned off, so that both the first capacitor chip and the second capacitor chip are maintained in a fully charged state;

wherein, when the first semiconductor switch module is turned on 100%, a first predetermined current is transmitted to the first light-emitting module through the first semiconductor switch module and the first current-limiting module;

wherein, when the second semiconductor switch module is turned on 100%, a second predetermined current is transmitted to the second light-emitting module through the second semiconductor switch module and the second current-limiting module;

wherein, when the first pulse width modulation signal is transmitted to the first semiconductor switch module at a first predetermined time point through the microcontroller chip of the microcontroller module, the first semiconductor switch module is turned on between a minimum predetermined percentage and 100%, so that the first predetermined current between a minimum predetermined percentage and 100% is correspondingly transmitted to the first light-emitting module through the first semiconductor switch module;

wherein, when the second pulse width modulation signal is transmitted to the second semiconductor switch module at a second predetermined time point through the microcontroller chip of the microcontroller module, the second semiconductor switch module is turned on between a minimum predetermined percentage and 100%, so that the second predetermined current between a minimum predetermined percentage and 100% is correspondingly transmitted to the second light-emitting module through the second semiconductor switch module;

wherein, when the first predetermined time point is earlier than the second predetermined time point, 100% of the first predetermined current is transmitted to the first light-emitting module through the first semiconductor switch module, and the minimum predetermined percentage of the second predetermined current is transmitted to the second light-emitting module through the second semiconductor switch module, each of the first LED chips is configured to generate a first predetermined color light source with 100% brightness, and each of the second LED chips is configured to generate a second predetermined color light source with a minimum percentage brightness;

wherein, when the second predetermined time point is earlier than the first predetermined time point, the minimum predetermined percentage of the first predetermined current is transmitted to the first light-emitting module through the first semiconductor switch module, and 100% of the second predetermined current is transmitted to the second light-emitting module through the second semiconductor switch module, each of the first LED chips is configured to generate a first predetermined color light source with a minimum percentage brightness, and each of the second LED chips is configured to generate a second predetermined color light source with 100% brightness.

* * * * *